US011560686B2

(12) United States Patent
Lancaster et al.

(10) Patent No.: US 11,560,686 B2
(45) **Date of Patent: *Jan. 24, 2023**

(54) MEMBRANE-LINED WALL

(71) Applicant: Levee Lock, LLC, Fargo, ND (US)

(72) Inventors: James H. Lancaster, Fargo, ND (US); Gerald L. Deneal, Harrisburg, IL (US); Eric E. Gregg, Harrisburg, IL (US)

(73) Assignee: Levee Lock, LLC, Fargo, ND (US)

( * ) Notice: Subject to any disclaimer, the term of this patent is extended or adjusted under 35 U.S.C. 154(b) by 12 days.

This patent is subject to a terminal disclaimer.

(21) Appl. No.: 17/313,659

(22) Filed: May 6, 2021

(65) Prior Publication Data

US 2021/0254301 A1 Aug. 19, 2021

Related U.S. Application Data

(63) Continuation of application No. 16/876,423, filed on May 18, 2020, now Pat. No. 11,001,983, which is a continuation of application No. 16/707,150, filed on Dec. 9, 2019, now Pat. No. 10,655,296, which is a continuation of application No. 16/220,139, filed on Dec. 14, 2018, now Pat. No. 10,501,908.

(51) Int. Cl.

| | |
|---|---|
| ***E02D 31/00*** | (2006.01) |
| ***E02D 29/02*** | (2006.01) |
| ***E02B 3/16*** | (2006.01) |
| ***E02B 3/10*** | (2006.01) |

(52) U.S. Cl.

CPC ..... *E02D 31/004* (2013.01); *E02B 3/10* (2013.01); *E02B 3/16* (2013.01); *E02D 29/0275* (2013.01); *E02D 2250/0023* (2013.01); *E02D 2300/0032* (2013.01)

(58) Field of Classification Search

CPC ..... E02D 31/004; E02D 29/0275; E02D 2250/0023; E02D 2300/0032; E02D 19/22; E02B 3/10; E02B 3/16; E02B 5/02; E02B 3/121

See application file for complete search history.

(56) References Cited

U.S. PATENT DOCUMENTS

| | | | |
|---|---|---|---|
| 3,197,964 | A | 8/1965 | Fehlmann |
| 3,854,292 | A | 12/1974 | Nienstadt |
| 3,990,200 | A | 11/1976 | Kawasaki |
| 4,453,861 | A | 6/1984 | Bretz |
| 4,666,334 | A | 5/1987 | Karaus |
| 4,728,226 | A | 3/1988 | Ressi di Cervia |
| 4,828,432 | A | 5/1989 | Ives |
| 4,927,297 | A | 5/1990 | Simpson |
| 4,929,126 | A | 5/1990 | Steenbergen |
| 4,934,865 | A | 6/1990 | Varkonyi |
| 4,955,759 | A | 9/1990 | Payne |
| 5,158,398 | A | 10/1992 | Pinho |

(Continued)

*Primary Examiner* — Carib A Oquendo
(74) *Attorney, Agent, or Firm* — Neustel Law Offices

(57) ABSTRACT

A membrane-lined wall for levee reinforcement or leak prevention, prevention of water migration, and pollution control of impoundments. The membrane-lined wall generally includes a cementitious or concrete wall formed within an excavated trench. The concrete may be internally reinforced, and the wall may also comprise a double-layer of impermeable geomembrane liner that forms a barrier between the concrete and the sides and bottom of the trench. The membrane or liner reduces water migration, prevents levee leakage, and prevents the escape of contaminants in impoundments.

23 Claims, 13 Drawing Sheets

(56) References Cited

U.S. PATENT DOCUMENTS

| | | | |
|---|---|---|---|
| 5,246,312 | A | 9/1993 | Taki |
| 5,454,668 | A | 10/1995 | Liao |
| 5,720,580 | A | 2/1998 | Ryhsen |
| 5,735,638 | A | 4/1998 | Beamer |
| 6,224,296 | B1 | 5/2001 | Fukumori |
| 6,443,666 | B1 | 9/2002 | Smith |
| 6,562,177 | B1 | 5/2003 | Payne |
| 6,786,446 | B1 | 9/2004 | Kaul |
| 7,373,892 | B2 | 5/2008 | Veazey |
| 8,387,334 | B2 | 3/2013 | Gulati |
| 8,613,573 | B2 | 12/2013 | Kadiu |
| 8,898,996 | B2 | 12/2014 | Garzon |
| 2008/0179253 | A1 | 7/2008 | Clark |
| 2009/0110490 | A1 | 4/2009 | Hess |
| 2009/0252555 | A1 | 10/2009 | Hartenburg |
| 2010/0215441 | A1 | 8/2010 | Saadatmanesh |
| 2017/0254037 | A1 | 9/2017 | Ragsdale, Jr. |
| 2019/0053445 | A1 | 2/2019 | Abdulzahra |

MEMBRANE-LINED WALL

CROSS REFERENCE TO RELATED APPLICATIONS

The present application is a continuation of U.S. application Ser. No. 16/876,423 filed on May 18, 2020 which issues on May 11, 2021 as U.S. Pat. No. 11,001,983, which is a continuation of U.S. application Ser. No. 16/707,150 filed on Dec. 9, 2019 now issued as U.S. Pat. No. 10,655,296, which is a continuation of U.S. application Ser. No. 16/220,139 filed on Dec. 14, 2018 now issued as U.S. Pat. No. 10,501,908. Each of the aforementioned patent applications, and any applications related thereto, is herein incorporated by reference in their entirety.

STATEMENT REGARDING FEDERALLY SPONSORED RESEARCH OR DEVELOPMENT

Not applicable to this application.

BACKGROUND

Field

Example embodiments in general relate to a membrane-lined wall.

Related Art

Any discussion of the related art throughout the specification should in no way be considered as an admission that such related art is widely known or forms part of common general knowledge in the field.

Levees have been in use for many years, and levee repair systems and methods for just about as long. Cutoff walls are one way to reinforce and prevent leakage in levees, but permeability of materials used (such as concrete) and soil contamination of the concrete during the curing process can reduce the integrity and strength of the cutoff wall. Further, without reinforcement, cutoff walls may be susceptible to seismic and other forces.

SUMMARY

An example embodiment is directed to a membrane-lined wall. The membrane-lined wall is formed in-place in a trench, typically a narrow, deep trench, formed by excavating the trench, typically along the top of a levee, although the wall system and the method for constructing it is particularly suitable for forming membrane-lined walls on the slope of a levee, as needed for localized problem areas.

In addition to levee reinforcement, the membrane-lined wall is also useful for stopping or preventing levees from leaking, for preventing pollution due to the migration of water or liquid contaminants, such as around the perimeter of waste disposal sites, coal slurry impoundments, and any other sites where groundwater movement should be stopped to prevent water contamination.

The membrane-lined wall comprises cementitious material, such as concrete, that fills the trench. The membrane-lined wall is formed by excavating a trench in the earth, the trench having two sides, a bottom, and a length. Next, a liner, which may be a low-permeability geomembrane, is installed in the trench along the length of the trench, the liner forming a continuous barrier between the two sides and the bottom of the trench and an interior portion of the liner in at least one dimension. After the liner is installed, a reinforcement mat is also installed within the interior portion of the liner, the reinforcement mat having a length aligned with the length of the trench, and having a height aligned with the two sides of the trench. As an example, the reinforcement mat may be a galvanized steel mesh, such as grade 40 galvanized wire mesh with rectangular openings. Other types of reinforcement, or reinforcement in addition to the mesh, may also be used.

The next step comprises filling at least part of the interior portion of the liner with a cementitious material that surrounds the reinforcement mat within the interior portion of the liner, wherein the weight of the cementitious material forces the liner into close contact with the sides of the trench, and then allowing the cementitious material to harden. The cementitious material, or concrete, can surround the reinforcement mat on three sides (such as both vertical sides and the bottom), or on all sides.

To add structural integrity, the reinforcement mat may come in sections, which are then joined together once they are in place in the trench to form a substantially continuous structure. In such an embodiment, the mat sections are joined together at a vertical edge between sections, so that the resulting reinforcement is aligned linearly along the length of the trench. For deeper trenches, multiple vertical sections of reinforcement mat may be required, and in such case, the sections may also be joined along the horizontal edges between them. The sides of the trench may be vertical in some example embodiments.

In an example embodiment, vibration, such as by an internal vibrator, may be applied to the cementitious material before it hardens. The vibration during the hardening process can remove air in the cementitious material and prevent honeycombing, which can weaken the wall.

In an example embodiment, the geomembrane liner comprises two layers of the low-permeability membrane, an inner layer adjacent to the interior portion of the liner, and an outer layer adjacent to the sides and the bottom of the trench. The inner layer of the liner may comprise multiple sections, wherein each section forms an overlap with an adjacent section along a first edge. Such multiple sections may also have an adhesive layer or coating applied at their edges between each adjacent section of the inner layer of the liner.

Further, the outer layer of the liner may comprise multiple sections, wherein each section of the outer layer forms an overlap with an adjacent section of the outer layer along a second edge. In such an embodiment, each overlap of the inner layer may be spaced apart from each overlap of the outer layer in a direction along the length of the trench.

In an example embodiment, forming the membrane-lined wall may further comprise positioning a roll of liner material over one side of the trench, positioning and clamping a lengthwise edge of the liner material over a side of the trench opposite the roll of liner material, and lowering a weight into the trench along the length of the trench to cause the liner material to unroll from the roll of liner material and extend into the trench. In using this method, the liner may then be cut from the roll, lengthwise, so that both edges of the liner (either one or two layers) are at the top of the trench, with a "pocket" of the liner extending down into the trench.

In addition to the preceding method of installing a liner, an example embodiment may further comprise positioning a second roll of second liner material over one side of the trench, and positioning and clamping a lengthwise edge of the second liner material over a side of the trench opposite the second roll of second liner material, and lowering a lengthwise weight into the trench to cause the liner material and the second liner material to unroll and extend into the trench. As with previous embodiments, the cementitious material may comprise concrete.

In another example embodiment, the liner of the membrane-lined wall comprises two layers of a low-permeability membrane, an inner layer adjacent to the interior portion of the liner, and an outer layer adjacent to the sides and the bottom of the trench.

There has thus been outlined, rather broadly, some of the embodiments of the membrane-lined wall in order that the detailed description thereof may be better understood, and in order that the present contribution to the art may be better appreciated. There are additional embodiments of the membrane-lined wall that will be described hereinafter and that will form the subject matter of the claims appended hereto. In this respect, before explaining at least one embodiment of the membrane-lined wall in detail, it is to be understood that the membrane-lined wall is not limited in its application to the details of construction or to the arrangements of the components set forth in the following description or illustrated in the drawings. The membrane-lined wall system is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

Figure 1:
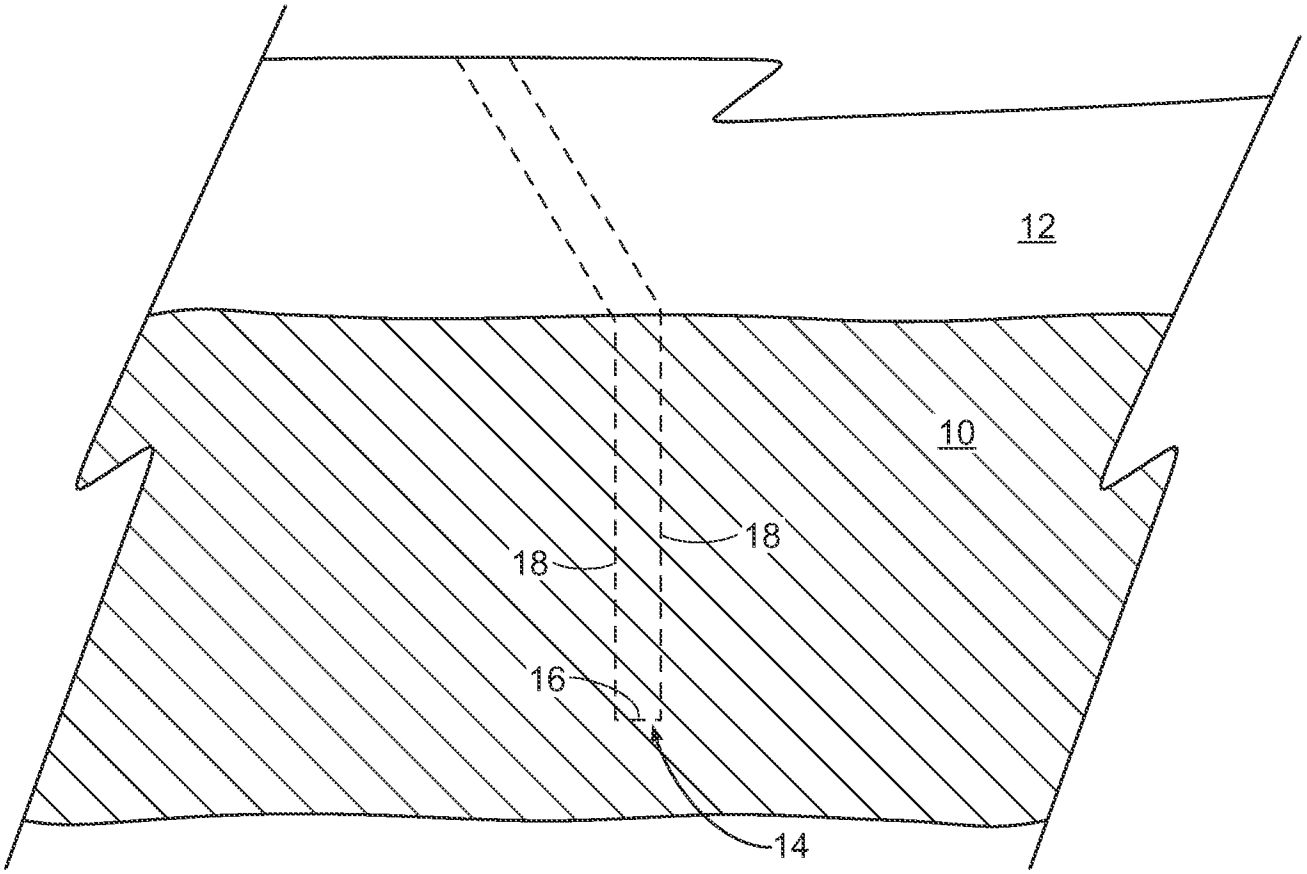
FIG. 1 is a perspective view of a site where a membrane-lined wall is to be installed in accordance with an example embodiment.
Figure 2:
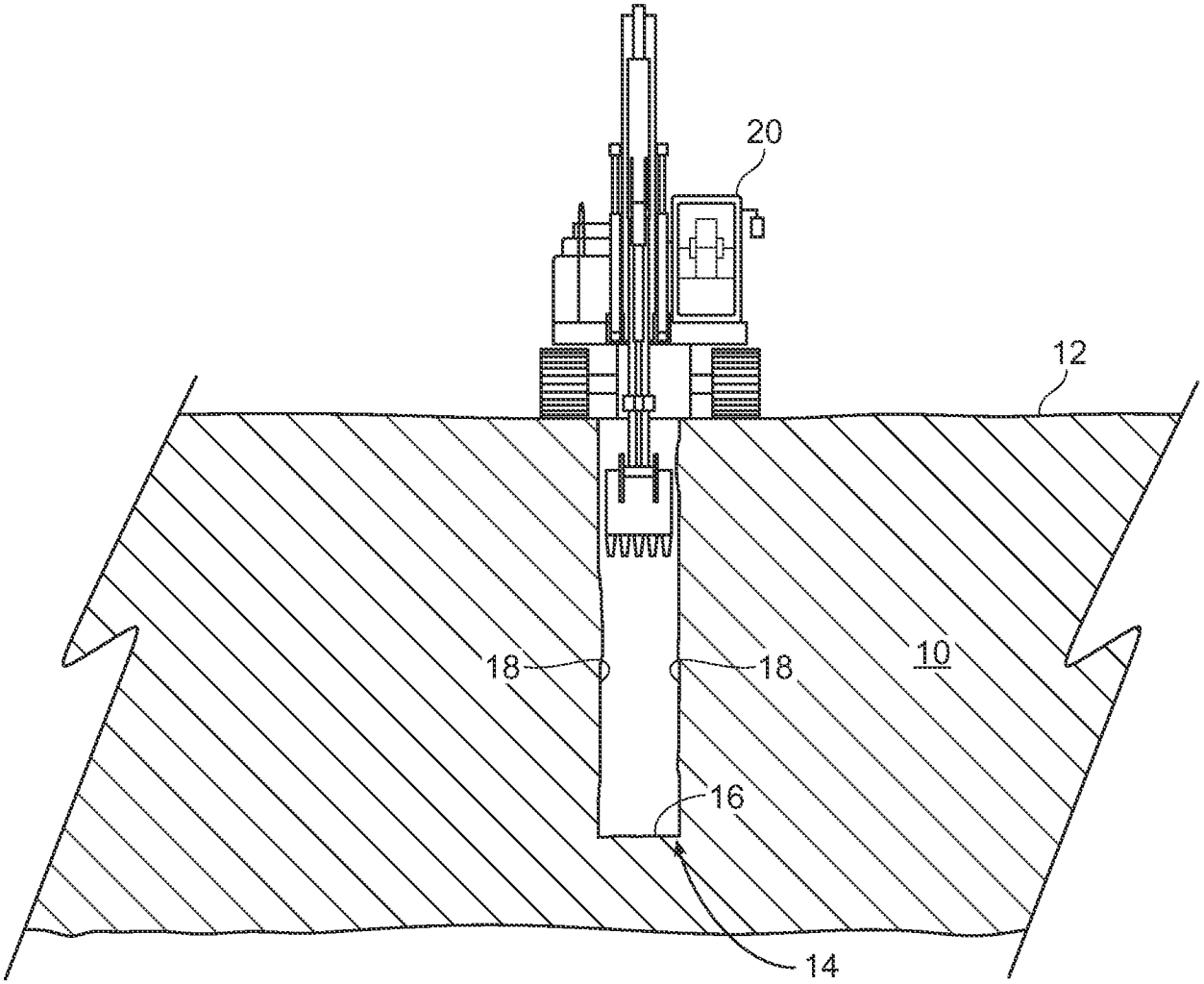
FIG. 2 is a sectional view of a site being excavated where a membrane-lined wall is to be installed in accordance with an example embodiment.

A. Overview.

An example membrane-lined wall generally comprises a reinforced, protected concrete wall 80 that is formed in place in a trench excavated in the desired location in the earth 10, such as the berm of a levee or the perimeter of a waste disposal site, as just two examples. The wall 80 can be formed anywhere it is needed, such as at the top, generally level portion of a levee berm, or it can be formed on a sloped portion of the berm, to strengthen, reinforce, or prevent leakage in a levee or other site in localized areas, as needed. Further, the methods described herein can be used anywhere a reinforced, waterproof in-ground wall is needed—not just for levees.

To form the wall 80 where it is needed, a location for trench 14 is first determined. This determination will include the location on the levee, waste disposal site, etc., as well as the needed depth and width. The trench, once formed, will comprise sidewalls 18 and bottom 16, and may be substantially rectangular, with a bottom 16 being horizontal or substantially horizontal, and the sidewalls 18 being vertical, or substantially vertical.

Wall 80 may generally comprise cementitious material 82, such as concrete. The wall 80 may also include a reinforcing mat or layer 84, which may be substantially parallel to the sides 18 of the trench 14. The reinforcing mat 84 may be, for example, made of galvanized steel. Further, multiple sections or pieces of reinforcing mat 84 may be installed in the trench 14 and held within the concrete or cementitious material 82, especially where the depth or length of the trench requires. For example, if the trench 14 is too deep or too long for a single piece of reinforcing material, multiple sections or pieces of reinforcing mat 84 will be needed. Such multiple sections may be joined together for added strength, either in multiple horizontal sections, multiple vertical sections (one section atop another), or both horizontal and vertical sections.

The wall 80 may be protected by, for example, one or two layers of a low-permeability liner 62, such as HDPE geomembrane. Such liners are anti-aging, UV resistant, and are impermeable. Accordingly, by installing liners 62 in a trench before concrete or other cementitious material 82 is added, the liners will not only make the wall 80 substantially impermeable (which will make it last longer and be a more effective barrier against erosion, etc.), but the liner 62 will prevent any substances in the soil to contaminate the concrete or cementitious material during curing. This will result in a better concrete wall 80.

B. Trench Excavation.

Figure 3:
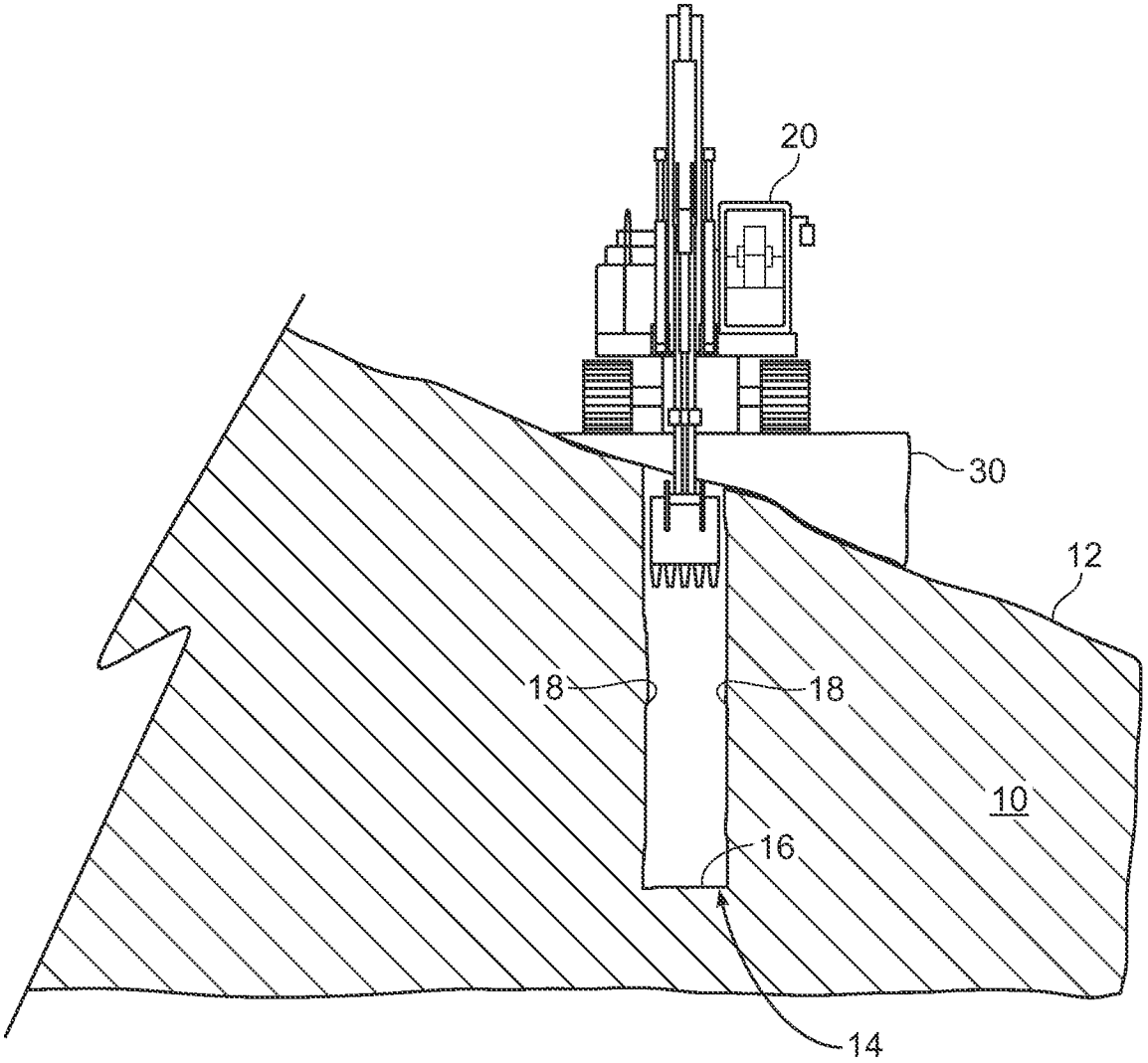
FIG. 3 is another sectional view of a site being excavated where a membrane-lined wall is to be installed in accordance with an example embodiment.
Figure 4:
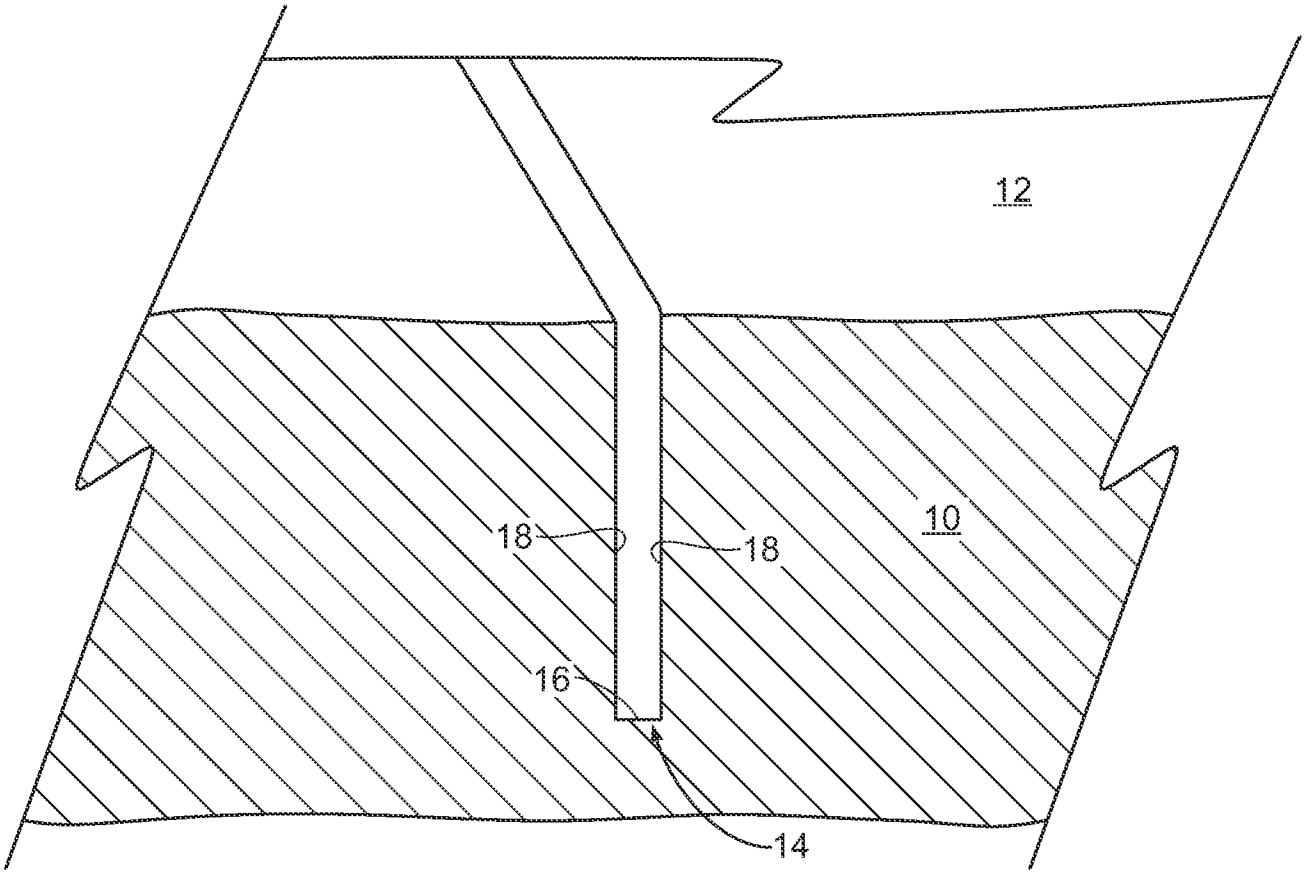
FIG. 4 is a perspective, sectional view of an excavated site where a membrane-lined wall is to be installed in accordance with an example embodiment.
Figure 5:
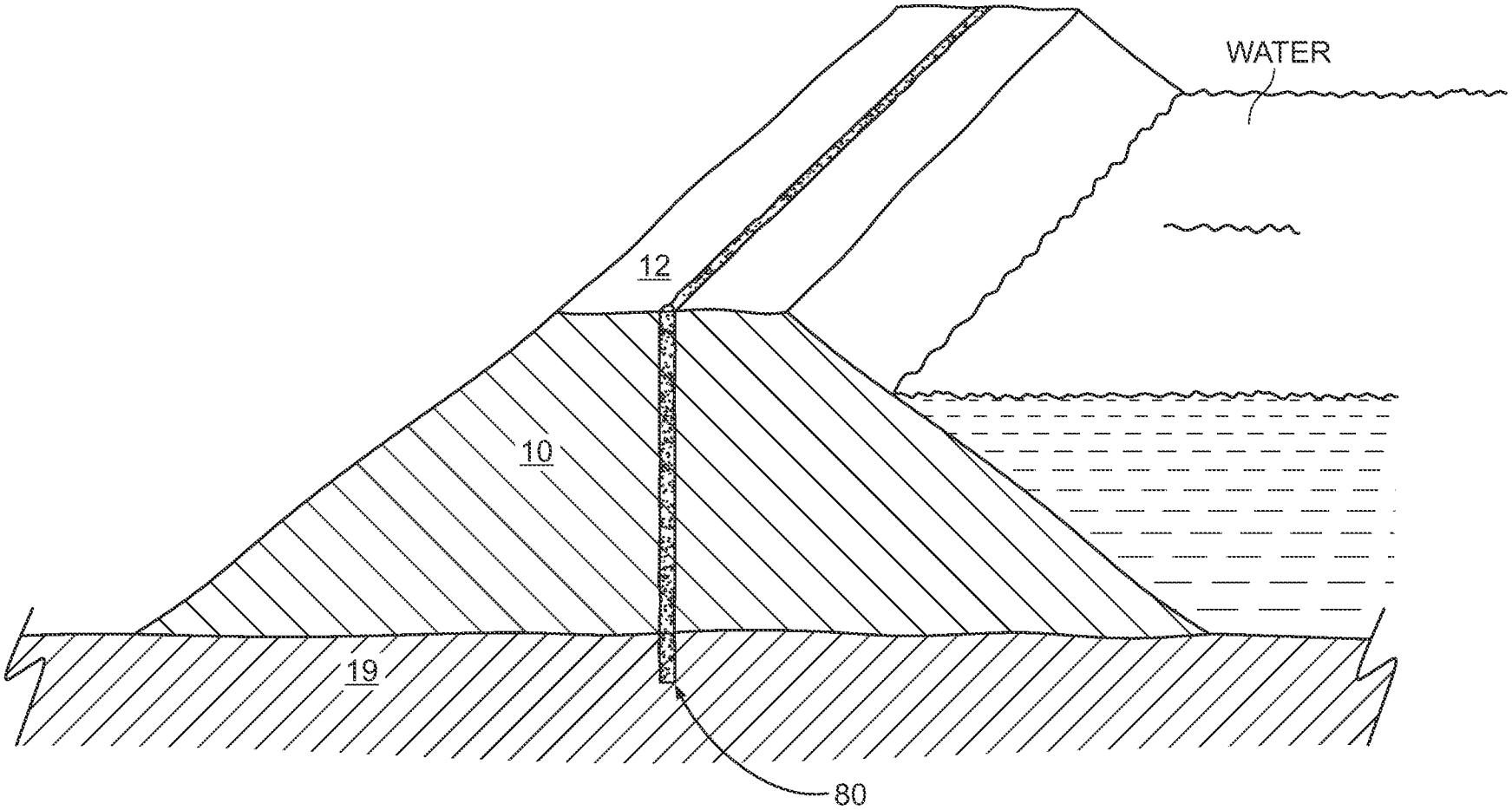
FIG. 5 is a perspective, sectional view of a membrane-lined wall installed in accordance with an example embodiment.

As shown in FIG. 1, the first step in forming the reinforced membrane-lined wall requires that a determination be made regarding location. Typically, the membrane-lined wall 80 will be formed along the top of a levee wall, as best shown in FIG. 5, although the wall can also be formed on the slope of a levee's berm, as shown in FIG. 3. Further, as stated previously, the membrane-lined wall can be used in other applications and locations, such as for containment ponds, slurry impoundments, etc. Once the desired location is determined, the trench 14 may be excavated from the surface 12 of earth 10 using an excavator 20, which may be a long-boom excavator, for example. For deeper trenches, other machines and techniques may be used as well.

Figure 14:
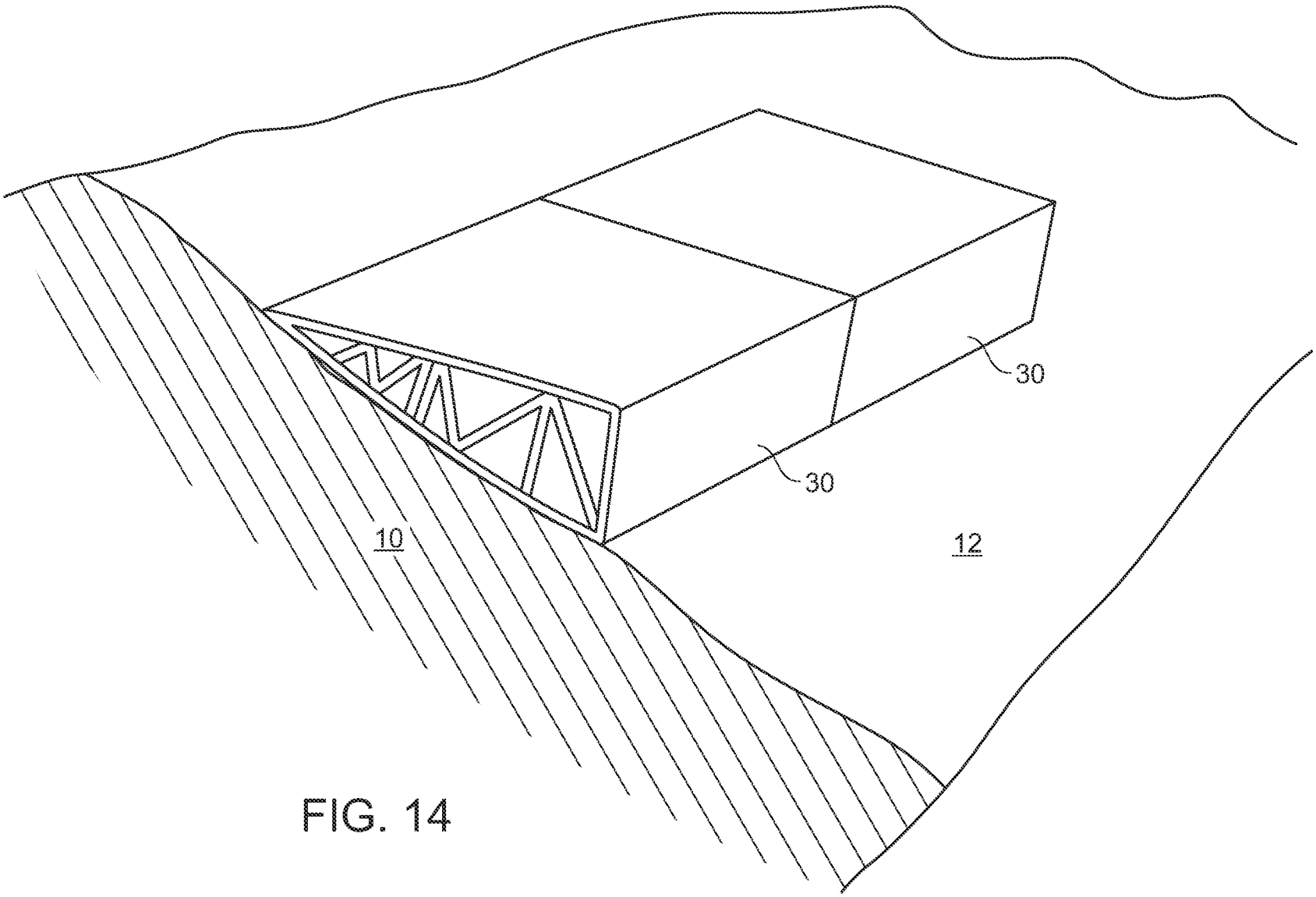
FIG. 14 is a perspective view showing two interlocking ramp sections for use in making a reinforced membrane-lined wall system in accordance with an example embodiment.

The trench, once excavated, will typically have sidewalls 18 and a bottom 16, as shown generally in the figures. As mentioned, the trench may be excavated on a slope, as shown in FIG. 3. If so, one or more interlocking leveling ramps 30 may be used to keep the excavator 20 substantially level during the excavation procedure. The interlocking leveling ramps 30 are also shown in FIG. 14. Since they are made in interlocking sections, ramps 30 can be disconnected from each other and continuously moved by workers as the trench excavation progresses, so that the trench can be made as long as needed, with each ramp section being moved successively to expose new sections of earth 10 to be excavated.

In an example embodiment, the trench 14 may be dug deep enough to extend into undisturbed, native soil 19, as shown in FIG. 5. Walls 80 extending to such depth and into native soil will typically have very good resistance to erosion by water action on the soil of earth 10 in the area to be reinforced.

If the soil to be excavated is not sufficiently firm, techniques may be used to hold or press the sidewalls of the trench in place, such as air bladders or plates forced apart by hydraulic cylinders, for example.

C. Liner.

Figure 8:
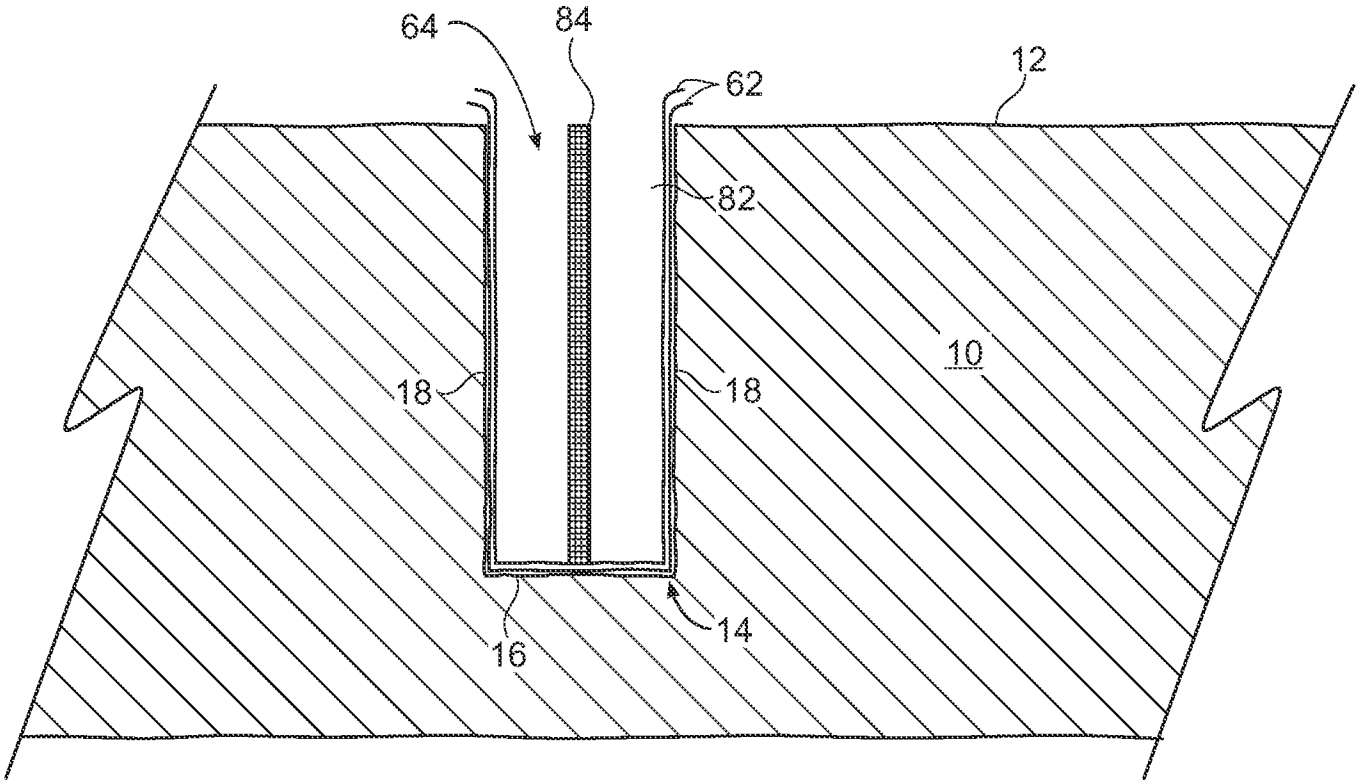
FIG. 8 is a sectional view of an excavated trench where a membrane-lined wall is to be installed in accordance with an example embodiment.
Figure 9:
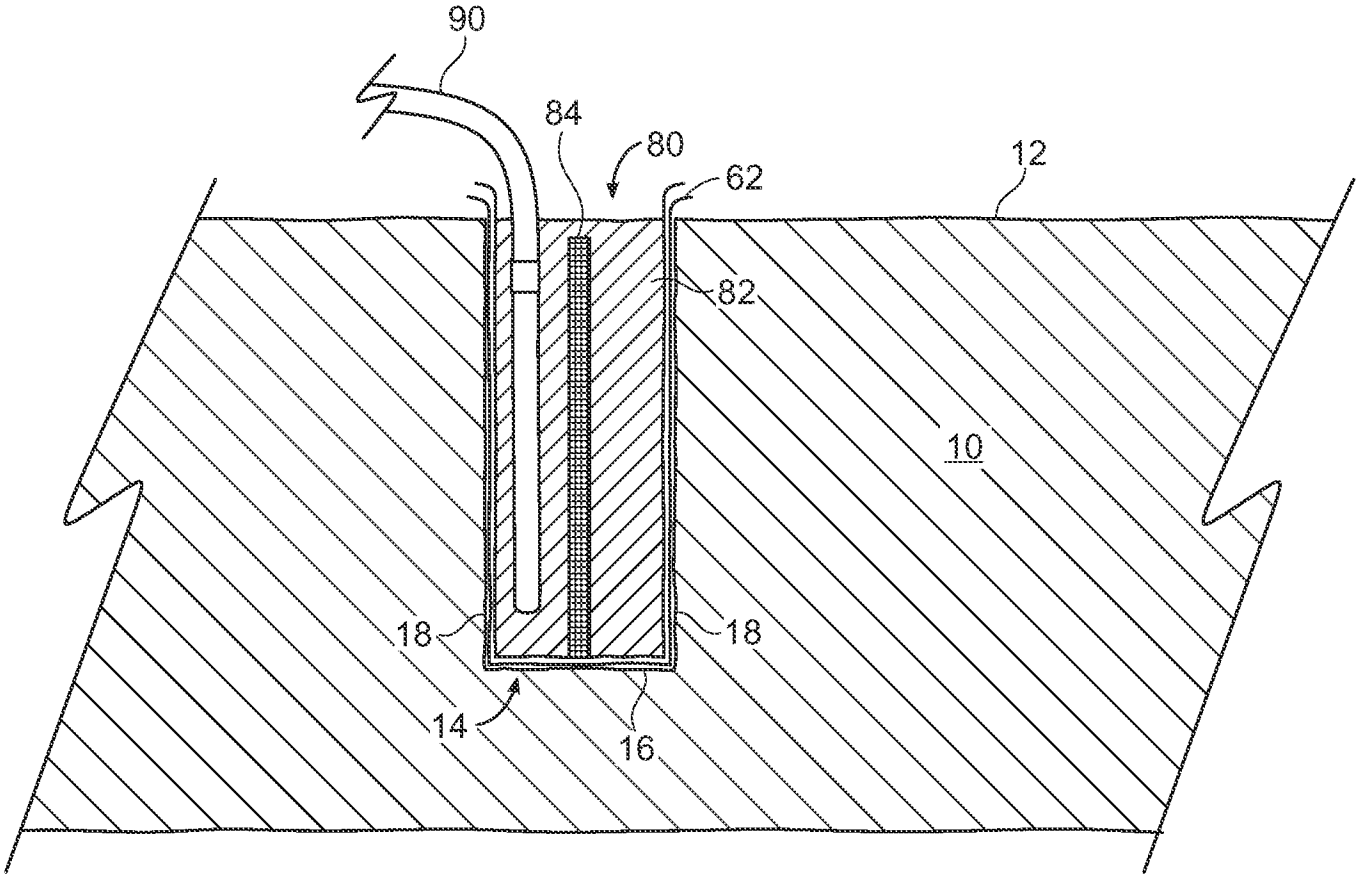
FIG. 9 is a sectional view of an excavated trench with a reinforced membrane-lined wall being installed in accordance with an example embodiment.
Figure 10:
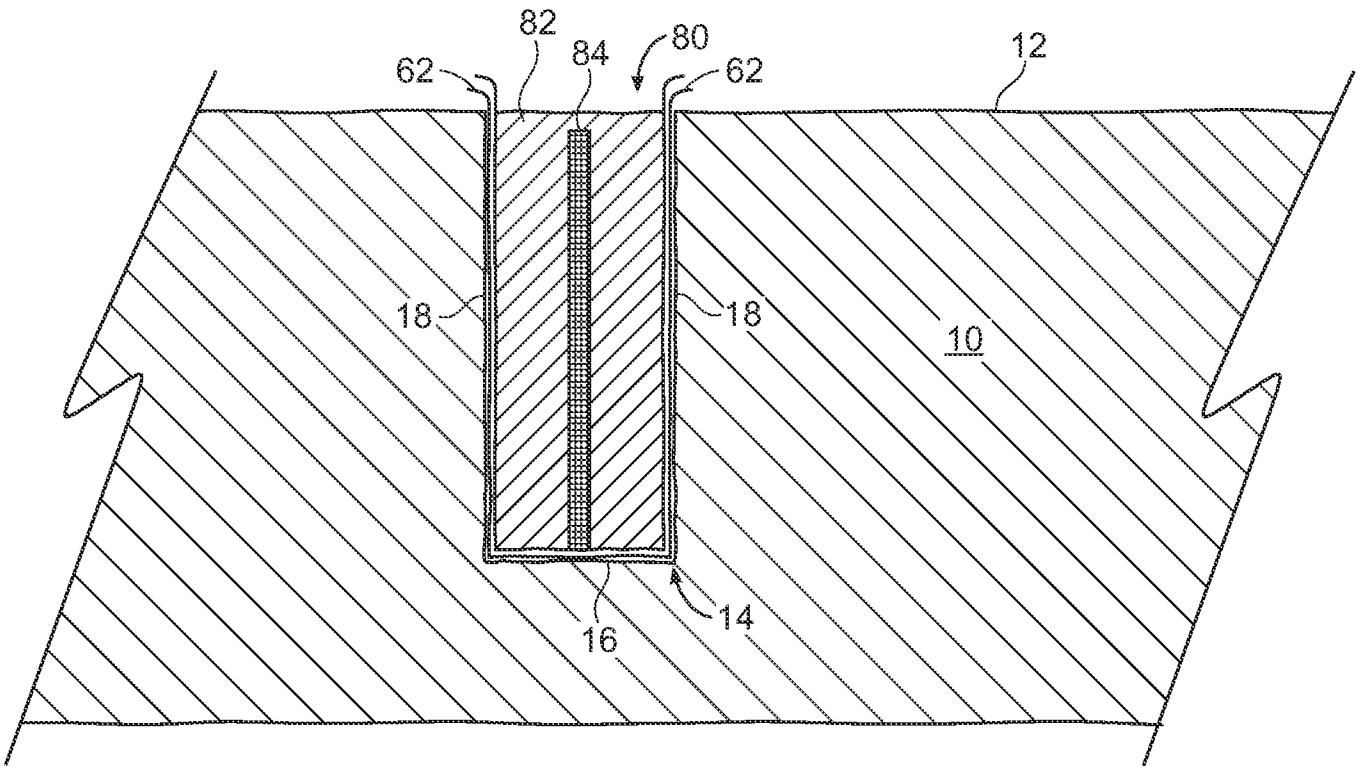
FIG. 10 is a sectional view of a reinforced membrane-lined wall in accordance with an example embodiment.

As best shown in FIGS. 8-10, the sides and bottom of the trench, and also the resulting wall, may be lined with one, and more preferably two, liner layers 62, to make the wall impermeable to water and other substances in the surrounding soil. As mentioned above, the liner 62 may be an impermeable HDPE geomembrane. This membrane may be a smooth HDPE liner, a textured HDPE liner, a composite liner (e.g., a combination of nonwoven or woven geotextiles with HDPE geomembranes), or other materials.

In addition to making the finished wall 80 more resistant to water flow and increased mitigation of internal water migration, the liner 62 also serves to prevent soil contamination in the concrete pour, ensuring competent concrete core integrity. In addition, the weight of the concrete tends to force the liner into close contact with the sides 18 of the trench, resulting in a tight seal to the sides 18 of the trench 14.

Figure 11:
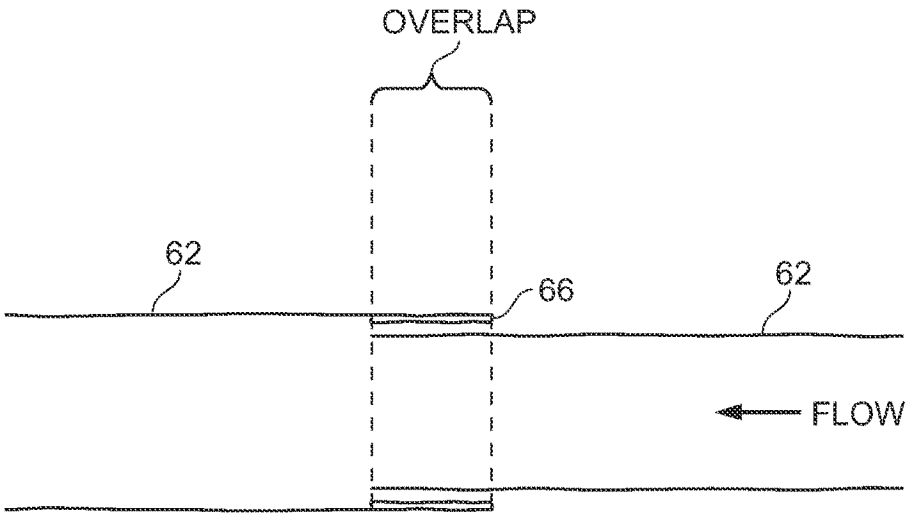
FIG. 11 is a top view of an inner liner layer for use with a reinforced membrane-lined wall in accordance with an example embodiment.
Figure 12:
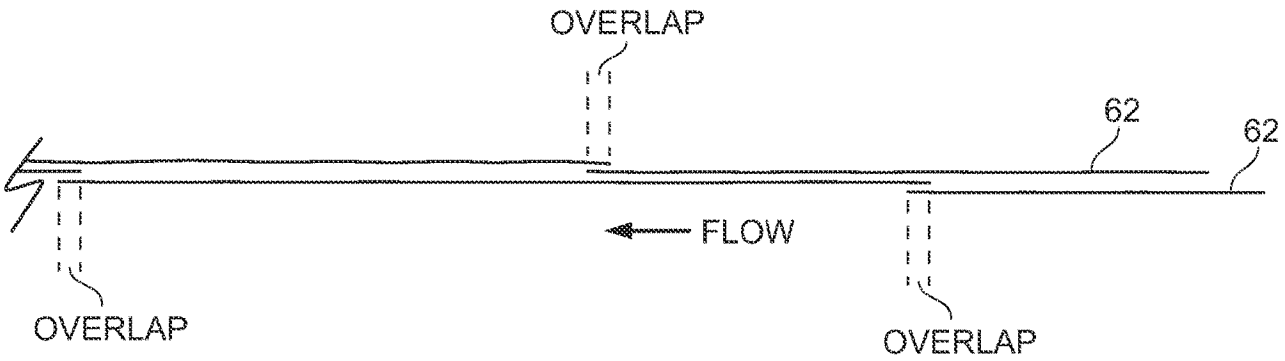
FIG. 12 is a top view showing two overlapping liner layers for use with a reinforced membrane-lined wall in accordance with an example embodiment.

As shown in FIGS. 11 and 12, the liner 62 may be made from multiple pieces of whatever liner material is used. This may be necessary, for example, for a wall 80 that is longer than the maximum available width of liner material. In that case, the liner may be overlapped at the edges. As an example, as shown in FIG. 11, the edges may have an overlap so that the innermost layer extends past the edge of the outer layer in the direction that cementitious material will flow when poured into the interior portion 64 of the liner. Because of this, weight of the material, such as concrete, will force the layers together before reaching the end of the first layer, so that the flow of material will not have a tendency to peel the layers apart, and will not tend to flow into the overlap area and out of the liner. Thus, the liner will tend to form a continuous barrier between the concrete and the sides 18 and bottom 16 of the trench 14.

In addition, if desired, an adhesive layer 66 may be added to further seal the layers of liner 62 together. In addition to an inner layer, the liner 62 may also comprise a second, outer layer, as shown in FIG. 12. The outer layer may be installed in the trench with each layer being parallel, one atop of the other. This would be the result of using the installation technique and equipment best shown in FIG. 7. However, the outermost layer could also have its edges, which also have an overlap, spaced away from the edges of the inner layer, which may further inhibit any water flow or seepage between the layers that, together, form the overall liner 62 of the wall 80.

Installed as shown in FIG. 12, this layer placement can ensure a long, or maximum length, path for any water to reach the interior of the wall from the earth 10 outside of the liner 62. Together, as well as individually, the layers of the liner material form a substantially continuous and impermeable barrier, having a "U" shape (viewed in cross section), between the reinforced concrete portion of the wall, and the sides 18 and the bottom 16 of the trench. The inside of this barrier forms an interior portion 64 of the liner 62.

D. Reinforcement Mat.

Figure 13:
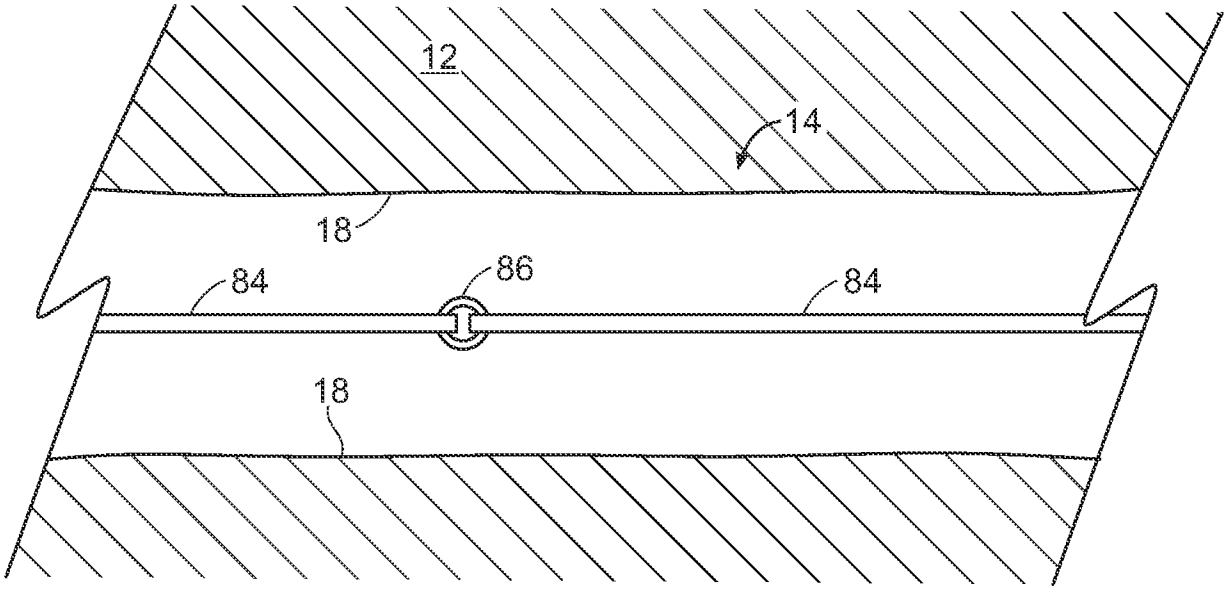
FIG. 13 is a top view showing two joined reinforcing mat sections for use with a reinforced membrane-lined wall in accordance with an example embodiment.

As best shown in FIGS. 8-10, a reinforcement layer 84, such as a galvanized steel reinforcement mat, may be installed in the trench after the liner 62 is in place. The reinforcement layer or mat 84 provides increased strength to the wall, and also increases the wall's resistance to seismic forces. If the wall 80 is to be larger, in any dimension, than the available sizes of the reinforcing mat material or other type of reinforcement, multiple pieces or sections of reinforcing mat may be used. For added strength, such sections or pieces can be joined together with a connector 86 before concrete is poured into the trench and liner. Any connection type may be used, and may include hog rings, bolts, wires, welding, etc. For fast joining, the sections may be joined together using a hog ring gun, which may result in the joined sections as shown in FIG. 13, which illustrates reinforcing mat 84 joined together with a hog ring or other connector 86.

E. Liner Installation Sled.

Figure 6:
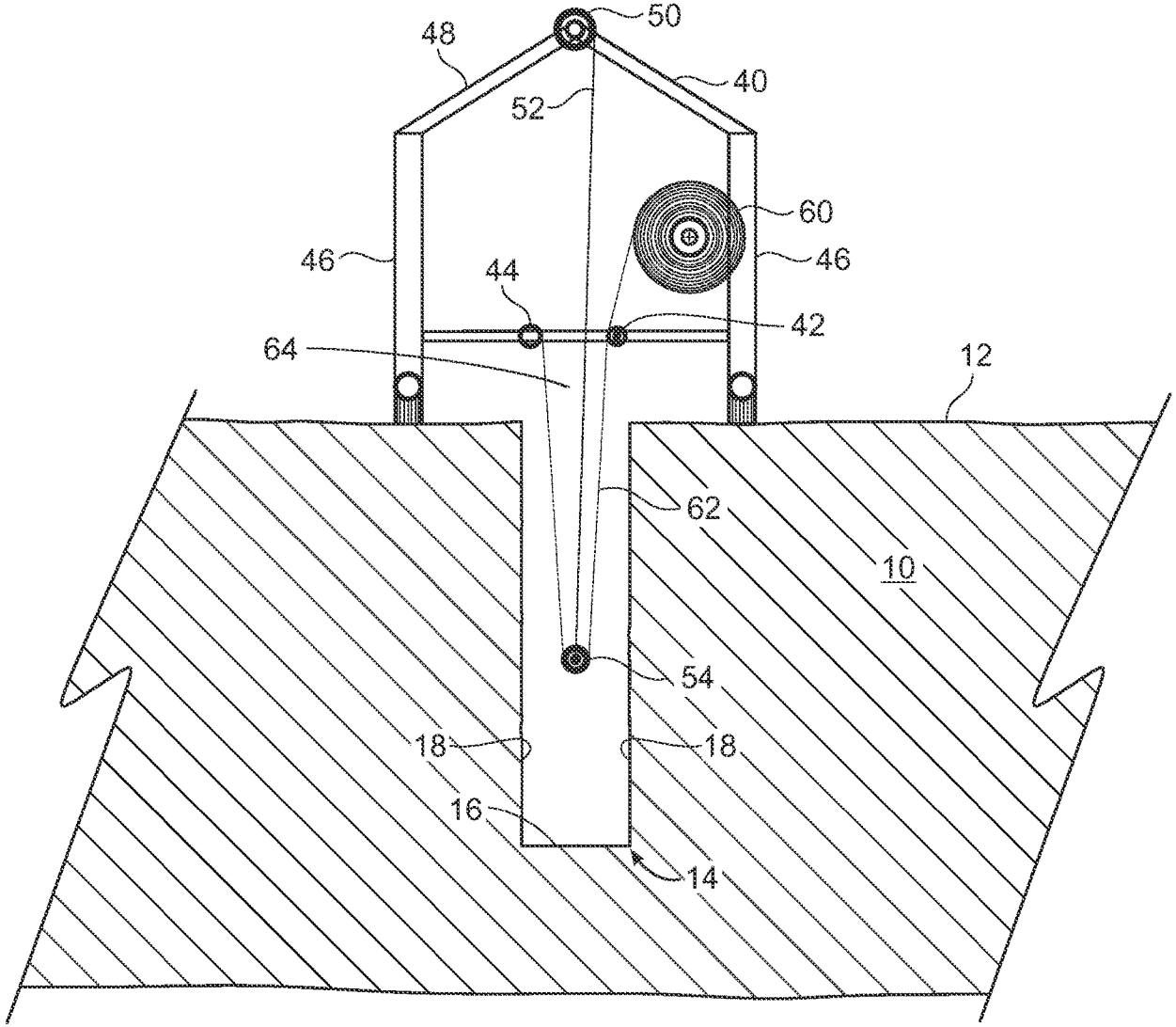
FIG. 6 is a sectional view of a liner being installed in an excavated trench where a membrane-lined wall is to be installed in accordance with an example embodiment.
Figure 7:
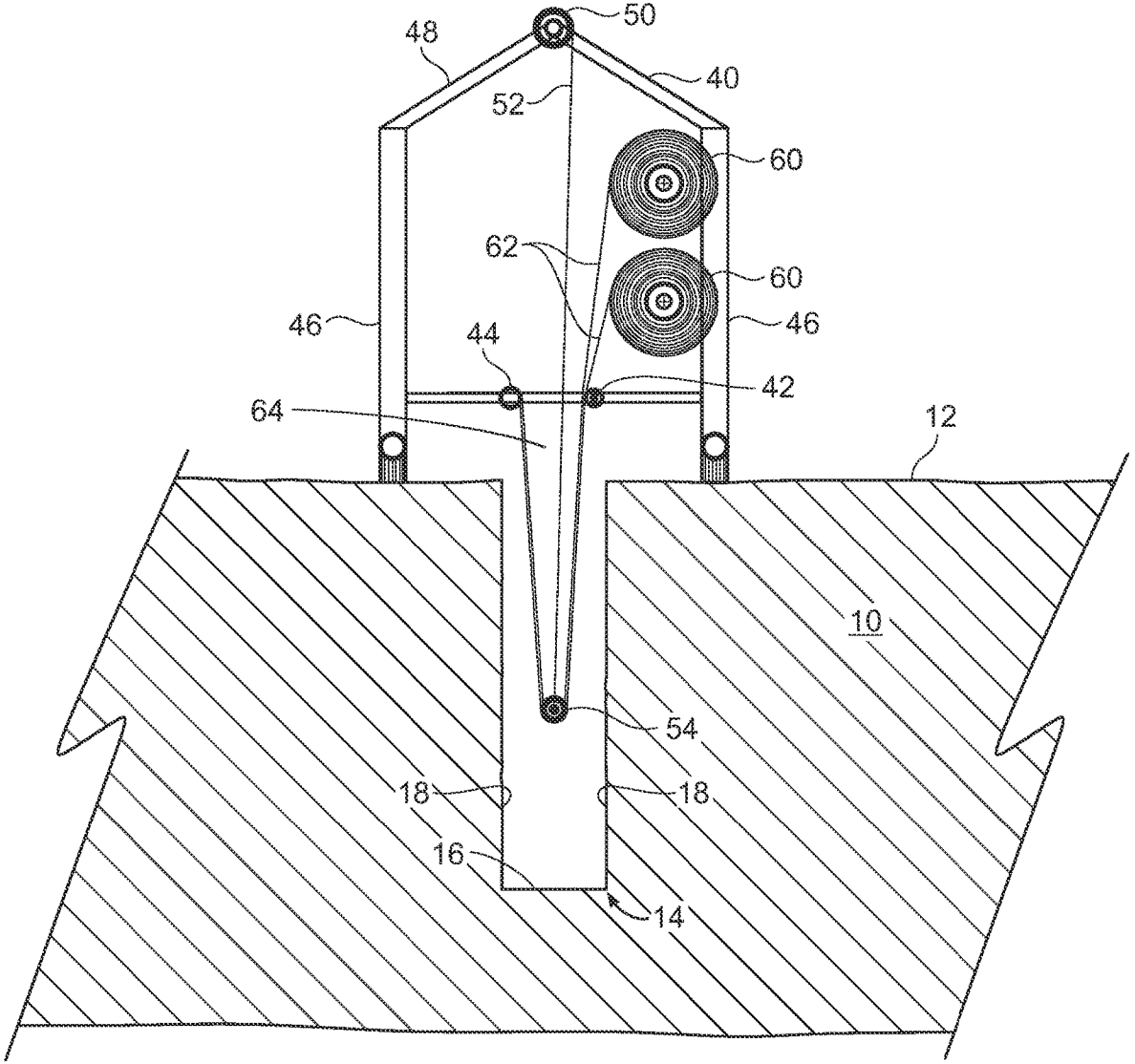
FIG. 7 is a sectional view of two layers of liner material being installed in an excavated trench where a membrane-lined wall is to be installed in accordance with an example embodiment.

As best shown in FIGS. 6-7, a specialized liner installation sled 40 may be used to quickly place or install the liner membrane into the trench 14. As shown, the sled 40 has side frame members 46 to support the sled and associated elements. The sled 40 also includes top frame members 48. For use on the sloping berm of a levee (or other sloping surface where a wall is needed), the side frame members 46 may be made with adjustable lengths, so that the upper portion of the sled 40 remains level even though the bottom skids are not.

As also shown, the sled 40 may have provision for mounting one or more large rolls 60 of geomembrane liner material, in position above and to one side of the trench 14. As shown in FIG. 7, the sled may accommodate two rolls 60 of geomembrane, one above the other. The rolls are supported vertically, but are allowed to rotate, so that with little force, the membrane material can unroll from the sled 40. With this sled, two layers of liner material 62 may be installed at the same time. The sled 40 also includes a positioning roller 42, a liner end clamp 44, a winch 50, and a winch cable 52.

As shown, the liner installation sled 40 is designed to hold one or more layers of liner 62 in position over the trench. Initially, the liner 62 extends over the trench 14 between the positioning roller 42 and the liner end clamp 44. Once so positioned, a user may activate winch 50 (which may be a power winch or a manual winch) to lower a weight 54, such as a lead pipe weight 54, into the trench. Lowering the weight will cause the liner roll 60, or both the upper and lower liner rolls 60 (FIG. 7) to unroll, so that the liner 62 drops into the trench 14 in the shape of a "U" or "V", creating an interior portion 64 or pocket, as shown, to create a continuous barrier between the interior portion 64 and the sides 18 and bottom 16 of the trench 14.

F. Operation of Preferred Embodiment.

In use, the desired location of a trench 14 may be determined, where a wall can best reinforce or prevent leakage in a levee, or wherever such a wall is needed to prevent water migration, contain pollution, etc. In just one example use, a membrane-lined wall 80 can be formed along the top of a levee, as best shown in FIG. 5, although the wall can also be formed on the slope of a levee's berm, as shown in FIG. 3. Once the desired location is determined, the trench 14 may be excavated from the surface 12 of earth 10 using an excavator 20, which may be a long-boom excavator, for example. For deeper trenches, other machines and techniques may be used as well. As discussed above, one or more interlocking leveling ramps 30 may be used to keep the excavator 20 substantially level while a trench is being dug. The interlocking leveling ramps 30 can be disconnected and continuously moved by workers as the trench excavation progresses, with each ramp section being moved successively to expose new sections of earth 10 to be excavated.

Once the trench has been dug, the liner installation sled 40 is used to hold the layer or layers of liner 62 in position over the trench and the sled and winch 50 are used as discussed above to lower a weight 54 into the trench, causing the liner roll or rolls 60 to unroll and the liner 62 to drop into the trench 14, creating an interior portion 64 or pocket, as shown, to create an impermeable barrier between the interior portion 64 and the sides 18 and bottom 16 of the trench 14.

In an example embodiment, the trench 14 may be deep enough to extend into undisturbed, native soil 19, as shown in FIG. 5. Walls 80 extending to such depth and into native soil will typically have very good resistance to erosion by water action on the soil of earth 10 in the area to be reinforced.

The liner 62 may, in an example embodiment, be lowered into trench 14 in a predetermined way, so that any overlapping portions of liner will resemble the overlap patterns shown in FIGS. 11 and 12. As shown in FIG. 12, the overlaps can be arranged and spaced so that the overlaps of the outer layer of liner 62 is at a maximum distance in either direction from the overlaps of the inner layer. This arrangement ensures that any water that might seep in between the layers of the outer layer will have to travel a maximum distance to reach the edge of an inner layer. The weight of the concrete when it is poured will tend to force the liner into close contact with the walls 18 and bottom 16 of the trench 14, so that a tight seal between the liner 62 and the sides and bottom of the trench is ensured, which can minimize or eliminate water entry into the wall system.

Once the liner 62 is in place within the trench, reinforcement mat 84 is installed within the interior portion 64 created by the liner. Typically, the reinforcement mat 84 will have a length aligned with the length of the trench, and a height aligned with the two sides of the trench. The mat will typically be positioned within the trench in the position shown in FIG. 8, and will eventually be surrounded by the cementitious material 82 of wall 80.

Next, concrete or other cementitious material 82 can be poured into the trench 14. For example, the material 82 can be poured from one end of the trench and allowed to flow into the trench in one direction, indicated by the arrows in FIGS. 11 and 12. With the flow in the direction shown, the flow of heavy cementitious material 82 will tend to close the overlapping edge of the inner layer, since it will already be exerting outward pressure against both layers (see, e.g., FIG. 11) by the time it reaches the overlapped edge of the innermost liner layer. Thus, the material 82 will not tend to flow between the two overlapping layers, as it might if allowed to flow in the opposite direction.

After the concrete or other material 82 is poured, but before it cures, an internal vibrator 90 may be used to effect a good cure, by removing or minimizing air within the concrete mixture. As is known, typically an internal vibrator may be repeatedly inserted (as shown in position in FIG. 9) into the concrete and then withdrawn at a controlled rate, which allows and causes the air in the concrete mixture to rise to the surface, rather than being held within the mix while the concrete hardens, creating "honeycombs." The vibrator 90, or multiple such vibrators 90 can be repeatedly inserted and withdrawn at various points along the length of the wall, after the concrete is poured, to reduce or eliminate trapped air. Thus, using the vibrator 90 causes the concrete to have greater strength and integrity. In addition to the separate vibrator 90 shown in FIG. 9, it would also be possible to vibrate the reinforcement mat 84 to achieve the same effect.

Unless otherwise defined, all technical and scientific terms used herein have the same meaning as commonly understood by one of ordinary skill in the art to which this invention belongs. Although methods and materials similar to or equivalent to those described herein can be used in the practice or testing of the membrane-lined wall, suitable methods and materials are described above. All publications, patent applications, patents, and other references mentioned herein are incorporated by reference in their entirety to the extent allowed by applicable law and regulations. The membrane-lined wall may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. A method, comprising:

positioning a roll of a liner over one side of a trench having two sides that define an opening to the trench, a bottom and a length, such that an axis of the roll is oriented along the length of the trench;

suspending and clamping an edge of the liner over the opening of the trench and proximate a side of the trench opposite the roll of the liner such that the edge is oriented along the length of the trench; and forcing a portion of the liner between the edge and the roll into the trench such that the liner is supplied from the roll and extends into the trench to form a continuous, seamless barrier between the two sides and the bottom of the trench and an interior portion of the liner.

2. The method of claim 1, further comprising filling at least part of the interior portion of the liner with a cementitious material;

wherein a weight of the cementitious material forces the liner into contact with the two sides of the trench.

3. The method of claim 2, further comprising the step of installing a reinforcement mat within the interior portion of the liner, wherein the reinforcement mat has a length aligned with the length of the trench, and wherein the cementitious material surrounds the reinforcement mat on at least three sides.

4. The method of claim 2, further comprising allowing the cementitious material to harden.

5. The method of claim 4, further comprising applying vibration to the cementitious material before it hardens.

6. The method of claim 1, wherein the liner comprises an inner layer adjacent to an interior portion of the trench, and an outer layer adjacent to the two sides and the bottom of the trench.

7. The method of claim 6, wherein the inner layer comprises multiple sections, wherein each section forms an overlap with an adjacent section along a first edge.

8. The method of claim 7, further comprising the step of adding an adhesive layer between each adjacent section of the inner layer of the liner.

9. The method of claim 7, wherein the outer layer comprises multiple sections, wherein each section of the outer layer forms an overlap with an adjacent section of the outer layer along a second edge, and wherein each overlap of the inner layer is spaced apart from each overlap of the outer layer in a direction along the length of the trench.

10. The method of claim 1, wherein the liner comprises a low-permeability membrane.

11. The method of claim 1, wherein forcing the portion of the liner between the edge and the roll into the trench comprises lowering a lengthwise weight into the trench along the length of the trench.

12. The method of claim 1, further comprising:

positioning a second roll of second liner material over one side of the trench; and positioning and clamping a lengthwise edge of the second liner material over a side of the trench opposite the second roll of second liner material.

13. The method of claim 1, wherein the clamping is performed by a liner end clamp that extends along a width of the liner.

14. The method of claim 13, further comprising extending the liner over a positioning roller that is suspended over the opening of the trench and proximate the one side of the trench, the positioning roller having an axis that is oriented along the length of the trench.

15. The method of claim 14, wherein the positioning roller is suspended at a substantially same height as the liner end clamp.

16. A method, comprising:

positioning a roll of a liner over one side of a trench having two sides that define an opening to the trench, a bottom and a length, such that the roll is oriented along the length of the trench, wherein the liner comprises an inner layer adjacent to an interior portion of the trench, and an outer layer adjacent to the two sides and the bottom of the trench;

suspending and clamping an edge of the liner over the opening of the trench and proximate a side of the trench opposite the roll such that the edge is oriented along the length of the trench; and forcing a portion of the liner between the edge and the roll into the trench such that the liner is supplied from the roll and extends into the trench to form a continuous, seamless barrier between the two sides and the bottom of the trench and the interior portion of the trench;

wherein the inner layer comprises multiple sections, wherein each section forms an overlap with an adjacent section along a first edge; and wherein the outer layer comprises multiple sections, wherein each section of the outer layer forms an overlap with an adjacent section of the outer layer along a second edge, and wherein each overlap of the inner layer is spaced apart from each overlap of the outer layer in a direction along the length of the trench.

17. The method of claim 16, further comprising filling at least part of the interior portion of the trench with a cementitious material;

wherein a weight of the cementitious material forces the liner into contact with the two sides of the trench.

18. The method of claim 17, further comprising the step of installing a reinforcement mat within the interior portion of the trench, wherein the reinforcement mat has a length aligned with the length of the trench, and wherein the cementitious material surrounds the reinforcement mat on at least three sides.

19. The method of claim 17, further comprising allowing the cementitious material to harden.

20. The method of claim 19, further comprising applying vibration to the cementitious material before it hardens.

21. The method of claim 16, further comprising the step of adding an adhesive layer between each adjacent section of the inner layer.

22. The method of claim 16, wherein the liner comprises a low-permeability membrane.

23. A method, comprising:

positioning a roll of a liner over one side of a trench having two sides that define an opening to the trench, a bottom and a length, such that the roll is oriented along the length of the trench, wherein the liner comprises an inner layer adjacent to an interior portion of the trench, and an outer layer adjacent to the two sides and the bottom of the trench;

suspending and clamping an edge of the liner over the opening of the trench and proximate a side of the trench opposite the roll such that the edge is oriented along the length of the trench; and forcing, with a lengthwise weight, a portion of the liner between the edge and the roll into the trench such that the liner is supplied from the roll and extends into the trench to form a continuous, seamless barrier between the two sides and the bottom of the trench and the interior portion of the trench;

wherein the inner layer comprises multiple sections, wherein each section forms an overlap with an adjacent section along a first edge; and wherein the outer layer comprises multiple sections, wherein each section of the outer layer forms an overlap with an adjacent section of the outer layer along a second edge, and wherein each overlap of the inner layer is spaced apart from each overlap of the outer layer in a direction along the length of the trench.

* * * * *